United States Patent [19]

MacDonald

[11] Patent Number: 5,058,397

[45] Date of Patent: Oct. 22, 1991

[54] CRYOGENIC STORAGE BOX FOR MICROCENTRIFUGE TUBES

[75] Inventor: Richard E. MacDonald, Lexington, Mass.

[73] Assignee: USA/Scientific Plastics, Inc., Ocala, Fla.

[21] Appl. No.: 574,065

[22] Filed: Aug. 29, 1990

[51] Int. Cl.[5] ..... F25D 3/08

[52] U.S. Cl. ..... 62/457.2; 62/371

[58] Field of Search ..... 62/457.2, 457.1, 371, 62/457.5, 1, 372, 466

[56] References Cited

U.S. PATENT DOCUMENTS

| | | | |
|---|---|---|---|
| 1,369,367 | 2/1921 | Thomson | 62/457.2 |
| 1,571,438 | 2/1926 | Schopf | 62/457.2 |
| 3,802,220 | 4/1974 | Pompo | 62/457.2 |
| 3,922,879 | 12/1975 | Arnold | 62/457.2 |
| 3,940,249 | 2/1976 | McClurg | 62/457.2 |
| 4,474,033 | 10/1984 | Baker | 62/457.2 |

*Primary Examiner*—Henry A. Bennett
*Assistant Examiner*—William C. Doerrler
*Attorney, Agent, or Firm*—Shlesinger, Fitzsimmons & Shlesinger

[57] ABSTRACT

The storage box includes a rectangular housing having a chamber filled with a coolant gel, and a plurality of spaced, tube-supporting wells opening at their upper ends on one wall of the housing and having closed ends extending downwardly into said chamber to be surrounded by said coolant gel. A cover which is hingedly connected to the housing, contains a sealed envelope containing more coolant gel, and which is disposed to overlie tubes that are positioned in said wells, when the cover is closed.

5 Claims, 3 Drawing Sheets

CRYOGENIC STORAGE BOX FOR MICROCENTRIFUGE TUBES

BACKGROUND OF THE INVENTION

This invention relates to the storage and protection of microcentrifuge tubes containing biological specimens such as heat-sensitive biologicals, enzymes, and the like; and more particularly this invention relates to a portable storage box of the type described which operates to maintain the contents of such tubes in an extremely cold ambient.

When not in use, it is essential that restriction enzymes and other heat sensitive biological specimens be stored in a freezer, or the like, so that they will remain dormant until used. Typically the freezers maintain the tubes, which contain such enzymes and heat labile biologicals, at temperatures ranging between 0° C. and −30° C. When they are to be used, a researcher usually removes a group of such tubes and their frozen contents from the freezer and places them at a convenient location on a bench top, where the tubes may remain for several hours at a time. During such intervals it is essential that the contents of the tubes, which often cost several hundred dollars per milliliter of volume, be maintained in their frozen or nearly frozen form until placed in use.

There are a number of disadvantages associated with known cold storage devices for such specimens. For example, most researchers store their restriction enzymes and heat sensitive biologicals in frost free freezers, despite the fact that such freezers have a heating cycle which operates to drive out condensation and to prevent frost. Consequently, biological specimens stored in those types of freezers may experience a fluctuating temperature profile, and as a consequence the specimens stored therein may be harmed by such fluctuations. Likewise, in the event of a power loss or "brown-out" event, the stored materials could be damaged as a result of the temporary failure of the freezer.

As for bench top ambients, enzymes and biological specimens of the type described are even more likely to be subjected to undesirable temperature fluctuations, unless extreme care is taken to maintain the unused materials consistently in a near frozen form. Although ice and dry ice devices have been suggested for bench top usage, they have proved to be rather ineffective. This is particularly true in those instances where it may be necessary to transport frozen specimens to one location or another, during which transfer the associated microcentrifuge tubes will be subjected to extreme temperature variations.

It is an object of this invention, therefore, to provide a portable, cryogenic storage box for removably supporting and maintaining enzyme-containing tubes and the like in an extremely cold atmosphere for prolonged periods of time.

Still another object of this invention is to provide a portable storage box of the type which is particularly suited for maintaining enzymes and heat sensitive biologicals in a frozen or near frozen ambient, whether in a freezer, on a bench top, or in transit from one locale to another.

A more specific object of this invention is to provide a portable, cryogenic storage box which is designed removably to support a plurality of microcentrifuge tubes in contoured openings that extend into and are surrounded by cold pack materials, which upon being frozen retain the box contents in an extremely cold temperature for prolonged periods of time.

Other objects of the invention will be apparent thereinafter from the specification and from the recital of the appended claims, particularly when read in conjunction with the accompanying drawings.

SUMMARY OF THE INVENTION

The storage box comprises a housing and a hinged cover therefore. The housing has a generally rectangularly shaped, flat bottom wall, and an integral, upstanding sidewall surrounding the bottom wall and closed at its upper end by a transverse upper wall, thus forming in the housing a large, generally rectangularly shaped chamber which is filled with a cooling gel. The upper wall of the housing has formed therein a plurality of tube-holding recesses in the form of integral, tubular-shaped wells or recesses which extend downwardly into the cooling gel to be surrounded thereby. The cover is hingedly connected along the rear edge thereof to the rear edge of the housing, and has on its forward side or edge a pivotal latching member which is releasably engagable with cooperating detents on the front wall of the housing to retain the cover releasably and sealingly closed over the upper end of the housing. The cover has in its underside a large recess containing a resilient, plastic envelope or casing in which is enclosed another supply of cooling gel.

After the box has been placed in a freezer long enough to freeze or render its cooling gels slushy, tubes containing biological specimens may be stored in the spaced wells or recesses in the upper wall of the housing, after which the cover may be latched closed to retain the tubes in the housing between the two layers of cooling gel.

THE DRAWINGS

DETAILED DESCRIPTION OF THE PREFERRED EMBODIMENTS

Figure 1:
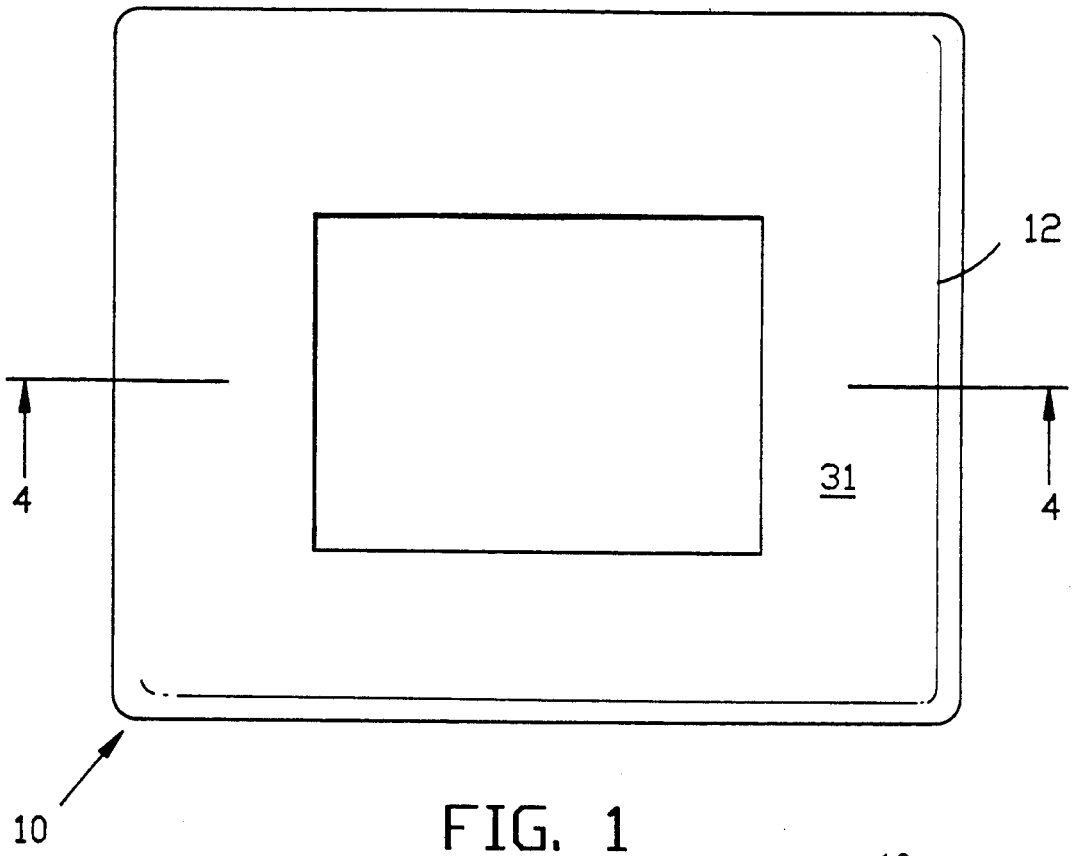
FIG. 1 is a plan view of a cryogenic storage box made according to one embodiment of this invention.

Referring now to the drawings by numerals of reference, 10 denotes generally a cryogenic storage box comprising a lower, tube-supporting housing 11 having thereon a hinged cover 12. Housing 11 is generally rectangular in configuration when viewed in plan, and by way of example may be made by a polypropylene blow molding process. It comprises a plane, flat bottom wall 14 that is surrounded by an upstanding, rectangularly shaped side wall 15, which is integral along its lower edge with the bottom wall 14. The upper end of housing 11 is sealed closed by an integral, transversely extending top wall 16, thereby forming a large, rectangular chamber 13 in housing 11. Wall 16 has a large, rectangularly shaped, tube-supporting section 17, which is spaced slightly below the upper end of the housing side wall 15, and is disposed in spaced, parallel relation to the lower wall 14.

Figure 4:
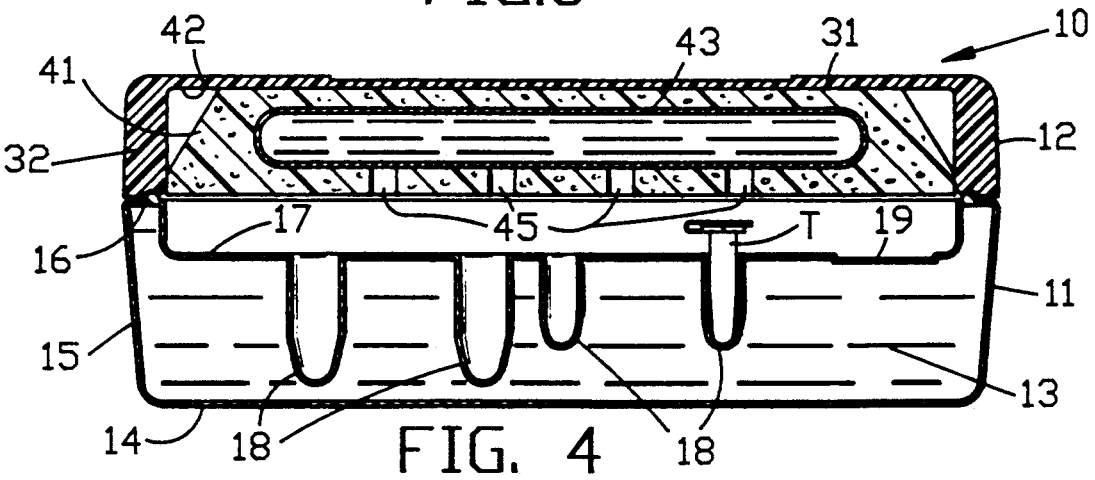
FIG. 4 is a sectional view taken generally along the line 4—4 in FIG. 1 looking in the direction of the arrows.
Figure 5:
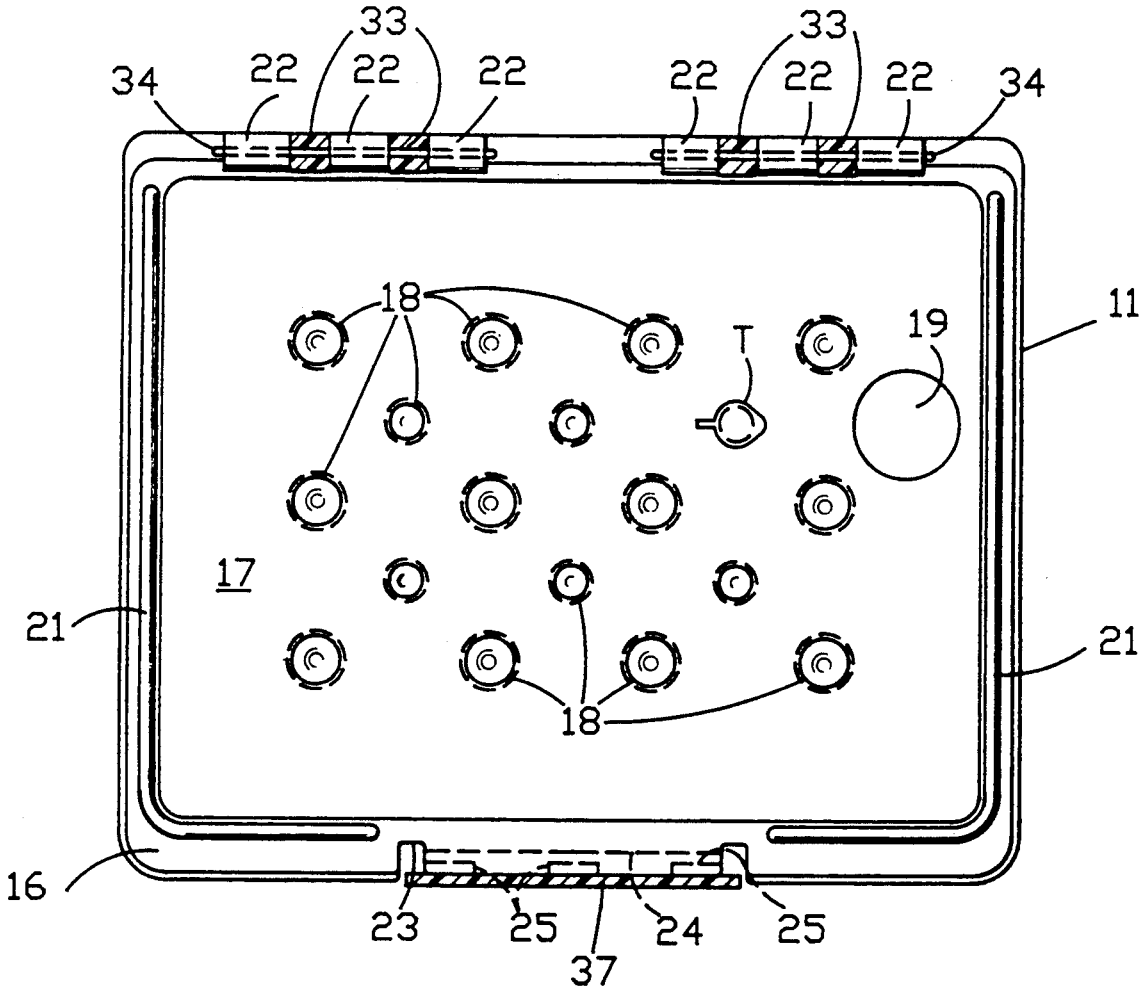
FIG. 5 is a sectional view taken generally along the line 5—5 in FIG. 2 looking in the direction of the arrows.

As shown more clearly in FIG. 4, the tube supporting section 17 of the upper housing wall 16 has formed therein a plurality of spaced wells or receptacles 18, which project downwardly into chamber 13. Wells 18 are tubular in cross section, and have closed lower ends that are spaced beneath section 17 but above the housing bottom wall 14. Sealed within chamber 13 in housing 11, and completely surrounding each of the downwardly depending wells 18 between the lower wall 14 and upper wall 17 of the housing, is a so-called "Kool-Pac Gel", which is adopted to function as a cryogenic material as noted hereinafter. A gel of the type described may comprise, for example, 85.88% $H_2O$, 6.3% NaCl, 7.5% corn starch, 0.2% acetic acid, and 0.12% methylparaben. The gel may be inserted into chamber 13 through a circular opening which may thereafter be sealed closed by a plug element 19 (FIGS. 4 and 5).

Projecting from the upper surface of the upper housing wall 16 adjacent opposite sides of the housing 11 are two, integral, elongate, generally L-shaped beads or bosses 21 (FIGS. 3 and 5), which, as noted hereinafter, are disposed to be releasably seated sealingly in registering grooves formed in the cover 12, when the latter is closed. As shown more clearly in FIG. 5, a portion of each boss 21 extends along the front wall of the housing 11, while remaining portions thereof extend parallel to each other along the upper edges of the opposed sidewalls of the housing. Integral with and projecting upwardly from the upper housing wall 16 adjacent the rear wall of the housing is a plurality of spaced, registering hinge pin barrels 22, which as noted hereinafter are adapted to be employed in hingedly connecting cover 12 to housing 11. Projecting outwardly from the upper edge of the housing 11 centrally of its front wall, and through a rectangular recess 23 (FIGS. 2, 3 and 5) that is formed in the front wall of housing 11, is a latch engaging lip 24, which has projecting downwardly from its forward edge three, spaced, latching detents 25 the purpose of which will be described in greater detail hereinafter.

The cover 12, which also may be made by a polypropylene blow molding process, comprises a plane, flat upper wall 31 surrounded by an integral, downwardly depending skirt section or sidewall 32, the lower surface of which registers with the upper surface of the housing wall 16 outwardly of its recessed section 17. Integral with and projecting from the skirt section 32 of the cover 12 along the rear edge thereof are two pairs of spaced, laterally registering hinge barrels 33. One pair of barrels 33 is positioned in the spaces between one set of the hinge barrels 22 on housing 11, and the other pair thereof is disposed in the spaces between the other set of hinge barrels 22. Barrels 33 have therethrough axially extending openings which register with like openings in the flanking barrels 22 on housing 11; and each pair of barrels 33 on the cover 12 is pivotally connected to the adjacent barrels 22 on housing 11 by a hinge pin 34, which extends through the axially registering openings in the barrels 22 and 33. The lower edge of the sidewall or skirt section 32 of cover 12 also has therein a pair of generally L-shaped recesses or grooves 35 (FIG. 3) into which the bosses 21 on the housing 11 are adapted to be seated when the cover 12 is closed over the housing 11, as shown for example in FIG. 2.

Figure 2:
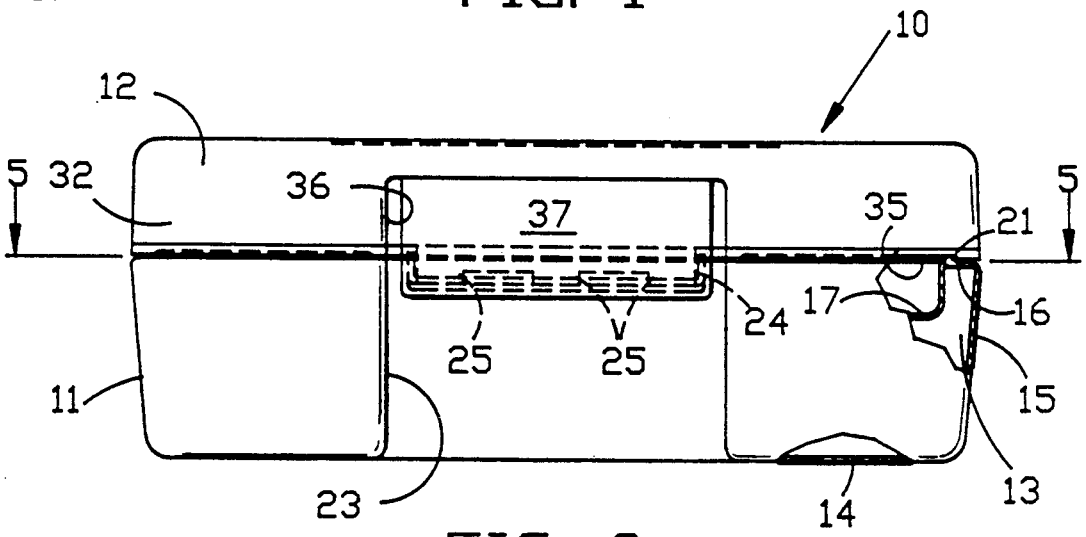
FIG. 2 is a front elevational view of this box.

Hingedly secured adjacent its upper edge to overlie a rectangular recess 36 (FIG. 2) in the front wall of skirt section 32 of the cover 12 is a rectangularly shaped latch 37. Latch 37 may form an integral part of the skirt section 32, and along its upper edge may be pivotally or hingedly attached to section 32 by the same material from which cover 12 is made. When the cover 12 is closed as shown in FIG. 2, the rectangularly shaped latch 37 projects at its lower end downwardly across the outer surface of the housing 11 in overlapping relation to the upper end of the housing recess 23 which is formed in the forward wall of housing 11. As shown in FIG. 2, latch 37 has formed thereon inside its lower edge an elongate rib or projection 38, which extends beneath and is releasably engagable with the projections 25 on the lip 24 when the cover 12 is closed. In other words, when the cover 12 is closed, the latch 37 may be urged manually adjacent its lower edge inwardly against the front wall of housing 11, and firmly enough to cause the rib 38 thereon to snap beneath the tabs or projections 25 on the front wall of the housing, thus securely closing the cover 12 over the housing 11.

Figure 3:
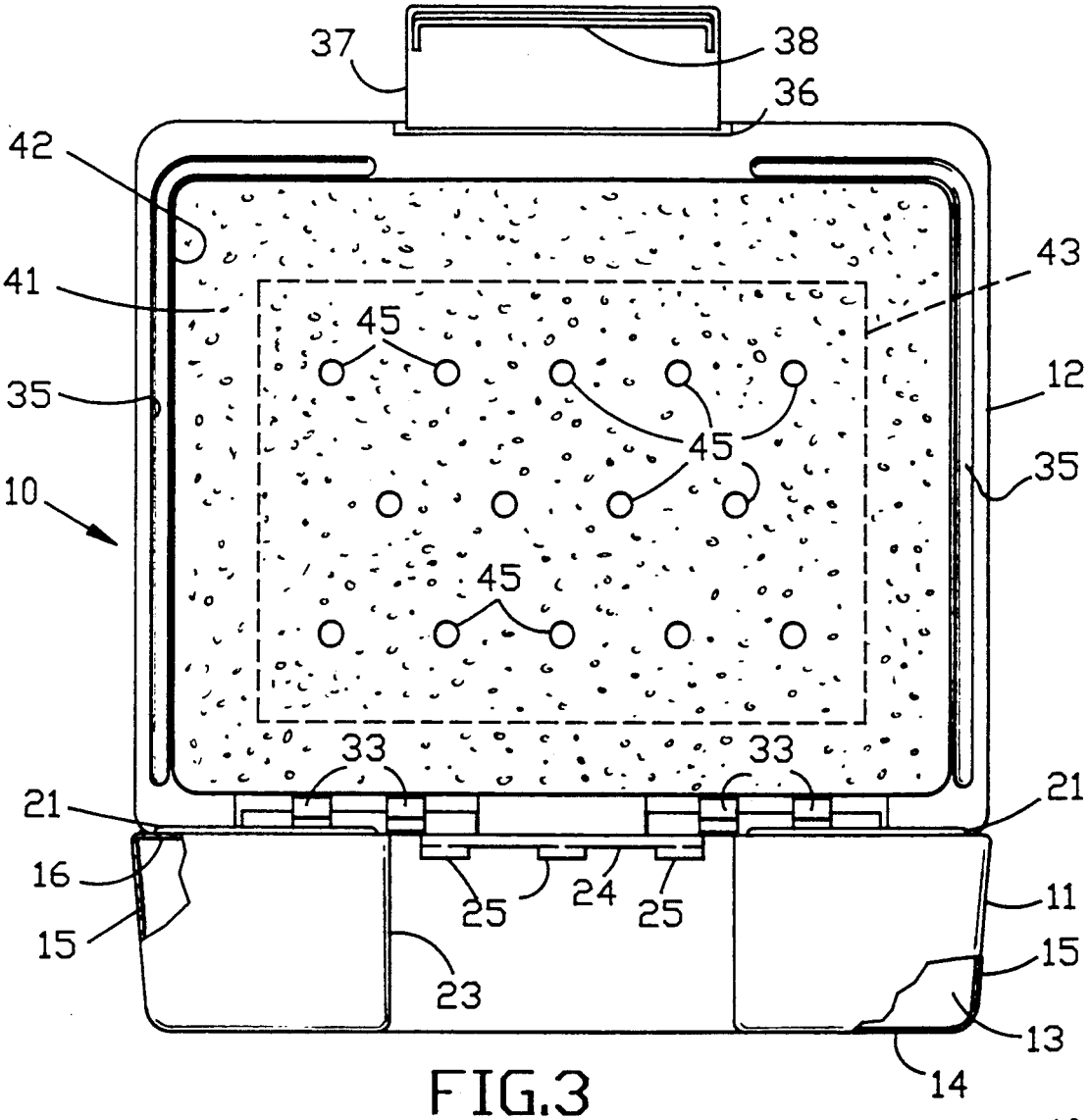
FIG. 3 is a front elevational view of this box but with the cover thereof open and shown in its upright position.

To supplement the cryogenic effect afforded by the gel contained in the housing chamber 13, the interior of the cover section 12—i.e., the rectangular recess 42 surrounded by the downwardly depending skirt portion 32 thereof, is substantially filled by a resilient, closed-cell polyethylene foam envelope or jacket 41. As shown more clearly in FIG. 4, the envelope 41 is at least as thick as the cover recess 42 in which it is housed. Moreover, enclosed within the envelope 41 is a large, rectangularly shaped, generally flat plastic jacket 43, which contains the same type of "Kool-Pac Gel", which fills the chamber 13 in housing 11. Preferably, although not necessarily, the envelope 41 is secured in the recess 42 so that when the cover 12 is swung to its open position, as shown in FIG. 3, the envelope 41 will remain within the cover recess 42. Also, if desired, the lower wall of the envelope 41, as shown for example in FIG. 4, may have therethrough a plurality of spaced, circular openings 45, which open at their inner ends on the cooling jacket 43.

In use, the box 10 is placed in a freezer, or the like, until the layers of gel in the chamber 13 and the envelope 43 becomes frozen, or nearly frozen or slushy. The cover 12 can then be opened and specimen bearing microcentrifuge tubes may be removably inserted into the wells 18 in the housing 11, closed ends down, as shown for example by the tube T in FIGS. 4 and 5. In this way substantially the entire length of each tube T will be immersed via its associated well 18 in the gel contained in housing 11. Thereafter the cover 12 may be closed to the position as shown in FIG. 4, wherein the chilled gel in the jacket 43 will maintain the space above the tubes also at an extremely cold or chilled temperature. Although in FIG. 4 the envelope 41 is illustrated a being spaced slightly above the upper end of the tube T, it will be understood that envelope 41 projects downwardly far enough to keep the tubes in place—i.e., to prevent them from becoming dislodged from the wells 18 when the box 10 is being transported from one spot to another.

From the foregoing it will be apparent that the present invention provides relatively simple and inexpensive means for protecting biological specimens of the type described from any undesirable harm which might otherwise result from exposing these specimens to fluctuating temperature profiles. By supporting the specimen bearing tubes in closely contoured wells or receptacles that are surrounded by the frozen gel in housing 11, the specimens can be maintained outside of a freezer for extremely long periods of time without being concerned with ambient temperature variations. Their stability is enhanced by utilizing also the second supply of gel in the cover section 12 of the storage box 10, and by the fact that the cover, when closed, is sealingly engaged around its edges with the lower housing section 11, so that warm air is not allowed accidentally to seep into the interior of the housing. Also, since the cavity or recess 42 in the cover 12 is substantially completely filled by the cryogenic envelope 41, there is little or no dead air space in the closed box, which means that when the box is closed any warm air that might then be located in the box will be forced out of the box upon closing of the cover. Still another advantage is that the resilient envelope 41 operates also to retain the tubes securely in their respective recesses or wells 18 in the housing 11, when the cover 12 is closed.

The novel box 10 thus is not only particularly suitable for bench top usage, but also functions as an excellent safety device when enclosed within a freezer. In other words, assuming that the box 10 contains heat-sensitive specimens, once the gels have been frozen or become slushy, any sudden accidental loss of power to the freezer will not be particularly harmful to the specimens, since the gels within the box 10 will retain the specimens in a cold or chilled atmosphere for prolonged periods of time even should the freezer power fail.

While a specific type of gel has been suggested, it will be apparent to one skilled in the art that other, conventional types of cooling gels, such as for example polyvinyl alcohol hydrogels, and the like could be substituted, provided that the gels function to form a rigid or slushy mass which will remain extremely cold for prolonged periods of time after having been subjected to a freezing atmosphere. Moreover, although one particular type of latching flap 37 is illustrated, it will be apparent also that other means of securing the cover 12 in its closed position over the housing 11 may be employed, if desired, without departing from this invention. Also, of course, materials other than polypropylene plastics and blow molding processes may be utilized for forming housing 11 and its cover 12.

Moreover, although only certain embodiments have been illustrated and described in detail herein, it will be apparent that this application is intended to cover any such modifications as may fall within the scope of one skilled in the art or the appended claims.

I claim:

1. A portable storage box for tubes containing heat sensitive biological specimens and the like, comprising a housing having spaced upper and lower walls, respectively, said upper wall of said housing having formed therein a plurality of spaced receptacles extending downwardly into the space between said walls for removably supporting therein a plurality of specimen containing tubes in said upper wall of said housing with the lower, closed ends of said tubes extending downwardly into said receptacles from said upper wall and into the space between said walls, a cover hingedly connected along one edge thereof to one edge of said upper wall of said housing for movement selectively into and out of a closed position over the tubes supported in said upper wall, a block of resilient material mounted in and substantially filling a recess in said cover, and disposed to be supported thereby over the upper ends of said tubes, when said cover is in its closed position a flexible envelope enclosed in said resilient block and containing a first supply of coolant gel, and a second supply of coolant gel substantially filling the space in said housing between said upper and lower walls thereof and disposed to surround said closed ends of said tubes which extend downwardly from said upper wall, said block of resilient material projecting downwardly in said recess far enough to form a resilient buffer which prevent said tubes from becoming dislodged from said receptacles when said cover is closed.

2. A portable storage box as defined in claim 1, wherein said spaced receptacles comprise a plurality of generally tubular shaped projections which open at their upper ends on said upper wall of said housing, and which have closed ends extending downwardly from said upper wall into said second supply of coolant to be surrounded thereby, each of said receptacles being disposed to have the closed end of a specimen bearing tube removably mounted therein.

3. A portable storage box as defined in claim 2, wherein said housing and said receptacles are made integral with each other from a molded plastic material.

4. A portable storage box as defined in claim 1, including cooperating latching means mounted on said cover and on said housing, respectively, and manually operable releasably to secure said cover in its closed position.

5. A portable storage box as defined in claim 1, including a plurality of openings in said block opening at one end on said envelope and at their opposite ends on the upper wall of said housing when said cover is in its closed position.

* * * * *